US008431876B2

(12) United States Patent
Bohorquez Cortazar et al.

(10) Patent No.: US 8,431,876 B2
(45) Date of Patent: Apr. 30, 2013

(54) SYSTEM FOR CONTROLLED AGING OF ELECTRICAL WINDINGS

(75) Inventors: Jose Armando Bohorquez Cortazar, Antioquia (CO); Andres Emiro Diez Restrepo, Antioquia (CO); Juan Carlos Toro Londoño, Antioquia (CO); Jairo Leon Restrepo Velasquez, Antioquia (CO); Hector Diego Gonzalez Sanchez, Antioquia (CO); Hugo Alberto Cardona Restrepo, Antioquia (CO); Gabriel Jaime Lopez Jimenez, Antioquia (CO); Idi Amin Isaac Millan, Antioquia (CO); Emiro De Jesus Diez Saldarriaga, Antioquia (CO)

(73) Assignee: Empresas Publicas de Medellin E.S.P., Medellin (CO)

( * ) Notice: Subject to any disclaimer, the term of this patent is extended or adjusted under 35 U.S.C. 154(b) by 321 days.

(21) Appl. No.: 12/845,776

(22) Filed: Jul. 29, 2010

(65) Prior Publication Data

US 2012/0024841 A1 Feb. 2, 2012

(51) Int. Cl.
*H05B 6/10* (2006.01)

(52) U.S. Cl.
USPC ..... 219/636; 219/503; 219/633; 219/494; 219/497; 219/665

(58) Field of Classification Search ..... 219/636, 219/503, 633, 494, 497, 663, 665, 670
See application file for complete search history.

*Primary Examiner* — Thao Le
*Assistant Examiner* — Matthew Gordon
(74) *Attorney, Agent, or Firm* — Feldmnan Gale, P.A.; Rafael A. Perez-Pineiro

(57) ABSTRACT

The present invention provides system for testing an electrical winding element that is usually a stator bar or a stator winding. The stator bar is attached to a short circuit conductive element to form a closed short circuit of a single turn that acts as a primary circuit. The closed short circuit is connected to a step-up transformer that will act as a secondary circuit and which has at least two turns. The step-up transformer uses a controlled variable voltage source that charges the closed short circuit. Charging the closed short circuit creates a current in the stator bar inner conductive element, causing heat on the stator bar by induction. The system of the present invention is suitable for an accelerated thermal aging test that simulates closely how heat is created by induction on stator bars of electric machines.

7 Claims, 4 Drawing Sheets

FIGURE 2
Fig. 2A
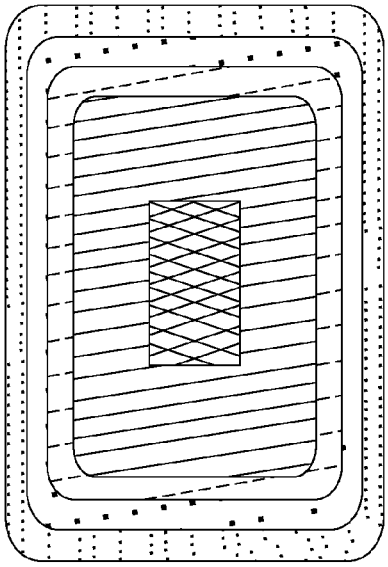
Fig. 2B
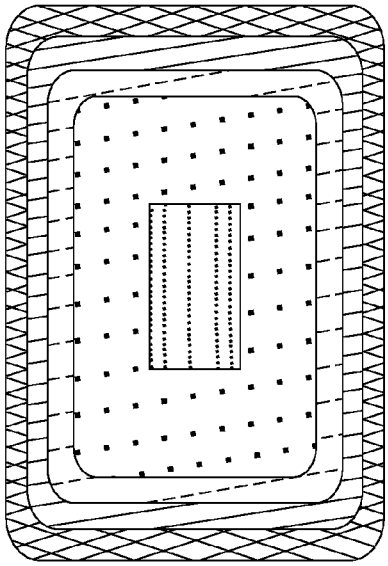
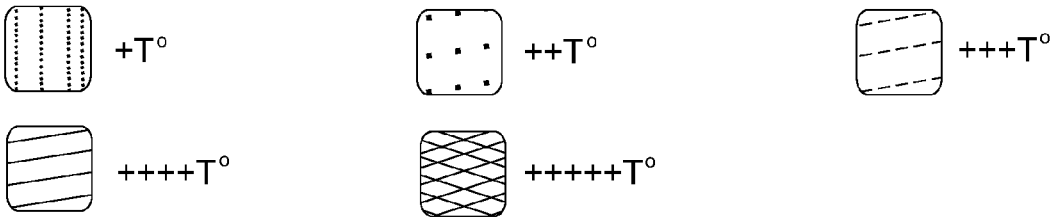

SYSTEM FOR CONTROLLED AGING OF ELECTRICAL WINDINGS

BACKGROUND OF THE INVENTION

1. Field of the Invention

The present invention is related to a system that causes artificial aging of electrical windings, wherein the system is mostly applied as an accelerated thermal aging test on stator bars or stator windings of electric machines.

2. Description of Prior Art

Stator bar or stator windings of big synchronous machines or electric machines that are in continuous service are exposed to aging factors such as heat that deteriorate the insulating material gradually, and unless there is regular monitoring and maintenance, complete machine failures can occur. Failures of these machines are extremely costly.

One monitoring system is the accelerated thermal aging of the stator bar wherein external heat is applied externally to the stator bar by means of an oven (see Electrical Insulation for Rotating Machines, Design, Evaluation, Testing and Repair, Stone, G. C. et al., page 59, IEEE Press Series on Power Engineering, Wiley-InterScience, 2004, ISBN 0-471-44506-1), or by means of a heating plate (see China Patent Publication No. 1402413A or 1162953C by HENGKUN, YUE XIE, Abstract).

Applying heat externally or causing heat by conduction to the stator bar during the described accelerated thermal aging test has the limitation of no simulating how heat is generated in the stator bar during the normal operation of the electric machine. Under normal operation conditions of an electrical machine, the stator bar heat is generated internally by induction because of the electrical current passing through the internal conductive component of the stator bar.

The present invention simulates how heat is generated in the stator bar when an electric machine is operating.

SUMMARY OF THE INVENTION

The present invention provides system for testing an electrical winding element (a stator bar or a stator winding). The stator bar is attached to a short circuit conductive element to form a closed short circuit of a single turn that acts as a primary circuit. The closed short circuit is connected to a step-up transformer that will act as a secondary circuit and which has at least two turns. The step-up transformer uses a controlled variable voltage source that charges the closed short circuit. Charging the closed short circuit creates a current in the stator bar inner conductive element, causing heat on the stator bar by induction. The system of the present invention is suitable for an accelerated thermal aging test that simulates closely how heat is created by induction on stator bars of electric machines.

Specifically the present invention provides a system for controlled accelerated aging of electrical windings, wherein the system comprises:

A. An electrical winding element and a short circuit conductive element, wherein the electrical winding element has an inner conductive component and an insulation component; wherein each one of the two elements, the electrical winding element and the short circuit conductive element, have two ends, where the two ends of the electrical winding element are attached to the two ends of the short circuit conductive element by means of two connections, wherein the two attached elements, the electrical winding element and the short circuit conductive element, form a closed short circuit;

B. An step-up transformer, wherein the step-up transformer uses a controlled variable voltage source, wherein the step-up transformer is connected to the closed short circuit, wherein the step-up transformer using a controlled variable voltage source, provides controlled variable charges to the closed short circuit;

C. A reactive power compensation part wrapped around a section of the electrical winding element, wherein the reactive power compensation part has a shielding component and an wrapping component, wherein the shielding component is grounded, wherein the wrapping component is a non-magnetic, non-sparking component;

D. A capacitor device, wherein the capacitor device is and additional component connected to the other reactive power compensation part components;

wherein charging of the closed short circuit with a controlled charge by the step-up transformer using a controlled variable voltage source, induces heat in the inner conductive component of the electrical winding element, wherein cycles of controlled charges by the step-up transformer using a controlled variable voltage source, generate cycles of flowing current through the closed short circuit, wherein the cycles of flowing current through the closed short circuit produce cycles of heat by induction in the electrical winding element, wherein said cycles of heat produce aging in the insulating component.

In a preferred embodiment of the system of the present invention, the electrical winding element is a stator bar.

In one aspect of the preferred embodiment of the system of the present invention, the inner conductive component of the electrical winding element is made of copper.

In another aspect of the preferred embodiment of the system of the present invention, the short circuit conductive element is made of copper.

In an additional aspect of the preferred embodiment of the system of the present invention, the two connections, that attach into the closed short circuit the electrical winding element and the short circuit conductive element, are made of copper.

In another aspect of the preferred embodiment of the system of the present invention, the shielding component of the reactive power compensation part is made of silicon steel iron.

In a further aspect of the preferred embodiment of the system of the present invention, the wrapping component of the reactive power compensation part is made of aluminum.

Additional objectives and advantages of the present invention will be more evident in the detailed description of the invention and the claims.

BRIEF DESCRIPTION OF THE DRAWINGS

FIG. 2 shows a diagrammatic representation of a heat gradient on a multiple layered electrical winding element when heat is created by induction and by conduction.

DETAILED DESCRIPTION OF THE INVENTION

Figure 1:
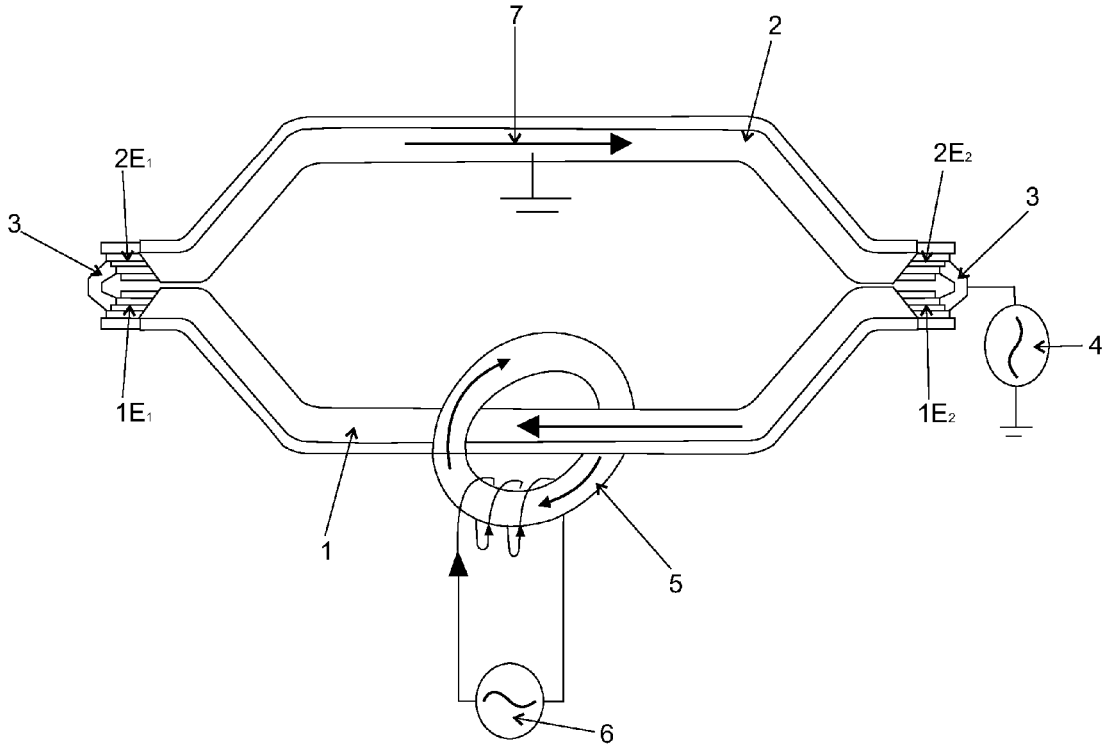
FIG. 1 shows an illustration of the system of the present invention.
Figure 3:
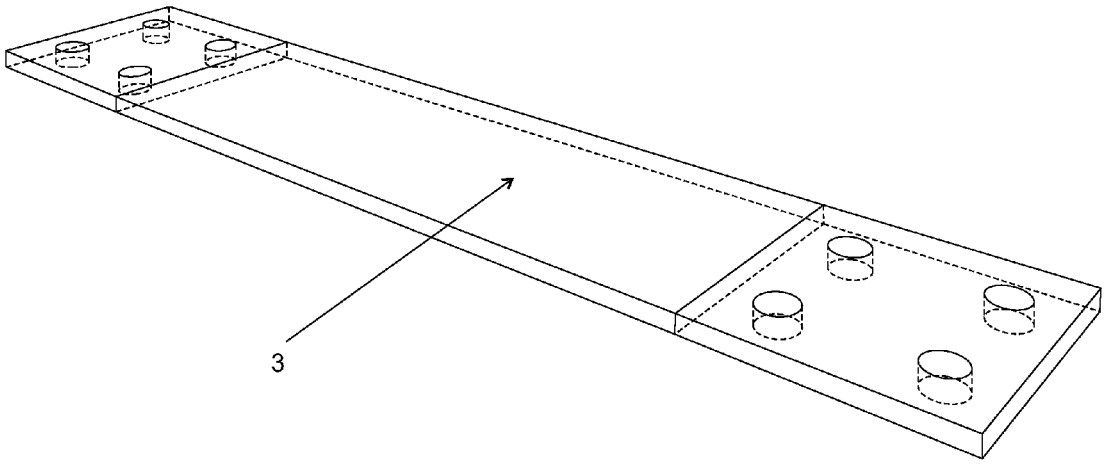
FIG. 3 shows the system of the present invention preferred connection to attach the tested electrical winding element to a short circuit conductive element to form a closed short circuit.

FIG. 1 shows the system for controlled accelerated aging of electrical windings, wherein the system comprises:

A. An electrical winding element (1) and a short circuit conductive element (2), wherein the electrical winding element (1) has an inner conductive component and an insulation component; wherein each one of the two elements (1 and 2), the electrical winding element (1) and the short circuit conductive element (2), have two ends ($1E_1$ $1E_2$ and $2E_1$ $2E_2$), where the two ends ($1E_1$ $1E_2$) of the electrical winding element (1) are attached to the two ends ($2E_1$ $2E_2$) of the short circuit conductive element (2) by means of two connections (3) (FIGS. 1, 3, and 4), wherein the two attached elements (1 and 2), the electrical winding element (1) and the short circuit conductive element (2), form a closed short circuit;

B. An step-up transformer (4), wherein the step-up transformer (4) uses a controlled variable voltage source, wherein the step-up transformer (4) is connected to the closed short circuit, wherein the step-up transformer (4) using a controlled variable voltage source, can provide controlled variable charges to the closed short circuit;

C. A reactive power compensation part (5) wrapped around a section of the electrical winding element (1), wherein the reactive power compensation part (5) has a shielding component and an wrapping component, wherein the shielding component is grounded, wherein the wrapping component is a non-magnetic, non-sparking component;

D. A capacitor device (6), wherein the capacitor device (6) is and additional component connected to the other reactive power compensation part components (5);

wherein charging of the closed short circuit with a controlled charge by the step-up transformer (4) using a controlled variable voltage source, induces heat in the inner conductive component of the electrical winding element (1), wherein cycles of controlled charges by the step-up transformer (4) using a controlled variable voltage source, generate cycles of flowing current (7) through the closed short circuit, wherein the cycles of flowing current (7) through the closed short circuit produce cycles of heat by induction in the electrical winding element (1), wherein said cycles of heat produce thermal aging in the insulating component.

The step-up transformer (4) that uses a controlled variable voltage source acts as a secondary circuit, wherein the step up transformer (4) using a controlled variable voltage, simulate the charging cycles of real electrical machines or motors.

For purposes of the present invention the step-up transformer is constituted by at least one transformer with several turns, or more than one transformer connected in parallel, wherein the transformers connected in parallel have additive polarity to guarantee that the induction of current is additive. When the step up transformer is constituted by more than one transformer connected in parallel with additive polarity, the amount of transformer connected in parallel depends on the amount of current to be inducted, and the impedance of the electrical winding element (stator bar) to be tested, wherein the following formula has to be complied with:

$$I_2/N_1=I_1/N_2 \text{ or } I_2\times N_2=I_1\times N_1 \text{ if } N_2>N_1 \text{ then } I_1>I_2$$

In the formula, $I_1$ is the current of the closed short circuit (primary circuit), $I_2$ is the current of the step-up transformer (secondary circuit), $N_1$ is the number of turns of the primary circuit, and $N_2$ is the number of turns of the secondary circuit. $I_1$ should compensate the motor-magnetic forces produced by the secondary circuits, and this is why $I_1$ has high values.

FIG. 2 shows a diagram illustrating a gradient of heat when heat is applied to a layered electrical winding element by induction (FIG. 2A) and by conduction (FIG. 2B). In FIG. 2, +T° means the lowest heat, ++T° means higher heat than +T°, and successively until +++++T° means the highest heat. FIG. 2A shows a gradient of heat from highest heat in the inner conductive component that is the most internal layer, to heat that is lower and lower toward the outside layers which are the insulating component. FIG. 2B shows the opposite gradient of highest heat in the most external layer to lowest heat in the most internal layer.

It is important to mention that depending on the insulation component region that is deteriorated, the polarity of the predominant partial discharges changes. Therefore, the present invention system for accelerated thermal aging is adequate to find models that correlate indicator trends for partial discharges with levels of deterioration of the insulating component.

The term electrical winding (1) element is synonymous with stator bar with one turn per bar, stator winding with just one turn, or any king of electrical winding with just one turn in an electric machine or electric motor.

In one aspect of the preferred embodiment of the system of the present invention, the inner conductive component of the electrical winding element (1) is made of copper; however the inner conductive component can be made of any appropriate material for a stator bar.

In another aspect of the preferred embodiment of the system of the present invention, the short circuit conductive element (2) is made of copper. In a preferred form the short circuit conductive element (2) is a longitudinal bar. Although the preferred material for the short circuit conductive element (2) is copper, the material could be any conductive material with similar electrical conductive properties as the inner conductive component of the electrical winding element.

In an additional aspect of the preferred embodiment of the system of the present invention, the two connections (3) that attach into the closed short circuit the electrical winding element (1) and the short circuit conductive element (2) are made of copper. Preferably, the connections are copper belts (3) with ends that are reinforced with steel to obtain higher mechanical resistance, wherein the copper belt ends are preferably electroplated to avoid corrosion. The connections can also be made with any other material with similar conductive electrical properties as the inner conductive component of the electrical winding.

In a preferred embodiment of the present invention the shielding component of the reactive power compensation part (5) is a pair of plate bars, wherein one of the plate bars is positioned along on top contacting a longitudinal section of the electrical winding element (1) and the other plate bar is positioned along below contacting the same longitudinal section of the electrical winding element (1). The thickness and material of the plate bars can be changed in order to achieve specific thermal characteristics.

In another aspect of the preferred embodiment of the system of the present invention, the shielding component of the reactive power compensation part (5) is made of silicon steel iron, wherein the silicon steel iron has high resistance to current.

The purpose of the shielding component is to adhere to the wrapping component, to concentrate the magnetic field, and to concentrate and dissipate heat, and also the fixing and mechanical protection of the insulating component of the electrical winding element.

In a further aspect of the preferred embodiment of the system of the present invention, the wrapping component of the reactive power compensation part (5) is made of aluminum.

The purposes of the wrapping component are to produce a closed and homogenous that is equipotential (equal and homogenous power in all part of the closed short circuit), and to neutralize the possible shielding component (plate bars) partial discharges because the increased electrical field.

The purpose of the capacitor device of the system of the present invention is to further neutralize the reactive power caused because of the charging of the closed short circuit by the step-up transformer using a controlled variable voltage source.

The capacitor device is constituted by a bank of one or more capacitors.

Additional objectives and advantages of the present invention will be more evident in the detailed description of the invention and the claims.

EXAMPLE

A prototype of the system of the present invention was built, wherein the prototype had a close short circuit that was made by joining the ends of a stator bar and a copper bar, wherein the copper bar had the same length and shape of the stator bar, wherein a current was inducted into the short circuit by means of seven transformers that were connected in parallel with additive polarity, wherein each one of the transformers connected in parallel had one turn, wherein the seven transformers connected in parallel constituted the step-up transformer, wherein the closed short circuit was the primary circuit and the transformers connected in parallel constituted the secondary circuit.

The prototype used a primary and secondary circuit with a relation of 2500:5, and with a level of insulation of a least 16 kV. The secondary circuit (step-up transformer were fed using a variable electric tension source with technical specifications as illustrated in the following Table 1.:

TABLE 1

| Technical Specifications | | |
|---|---|---|
| VARIABLE ELECTRIC TENSION SOURCE AC WITH POWER FACTOR CORRECTOR BANK | | |
| Tension Input | Vac | 220 |
| Frequency Input | Hz | 50-60 |
| Tension Output | Vac | 0-280 |
| Frequency Output | Hz | 50-60 |
| Maximum Current Output | A | 50 |
| Main Interrupter: Merlin Gerin Easy-pact EZC100B | | |
| Nominal Current | A | 50 |
| Breaking Capacity at 220 V | kA | 10 |
| Capacitors Bank | | |
| 100 μF@330 Vac | Units | 3 |
| 50 μF@330 Vac | Units | 2 |
| 30 μF@330 Vac | Units | 1 |
| Autotransformer | | |
| Nominal Power | KVA | 7.5 |
| Nominal Current | A | 26.7 |

Because the capacitor device component of the reactive power compensation part (in this prototype the capacitor device was constituted by a bank of three capacitors de 100, 50, and 30 μF @330V), the demand of current from the variable voltage source used by the step-up transformer was low (up to 20 A), while the primary current circuit was up to 2500 A.

The electric tension was provided by a variable source that allowed subjecting the stator bar to a power differential. The electric tension was applied to the inner conductive component of the stator bar and to the external surface using a monophasic variable transformer with a 380V/32 KV relation, and 160 kVA, free of partial discharges.

The prototype have a wrapping component made of aluminum foil that wrapped around the shielding component and the stator bar, wherein an endurance voltage test specifications were according to the std IEEE 1043 from 2000.

The prototype system allowed electric power distribution like it happens in an electric machine. The shielding component was made of two silicon steel iron plate bars on top and under the stator bar that imitate the iron plates of an electric machine, wherein the two silicon steel iron plate bars concentrate the magnetic field.

When voltages of 5000V or more are applied, there are probable partial discharges into the electrical winding element (stator bar) surrounding air because of a highly increased electric field. To attenuate this phenomenon, effort control treatment were applied to the stator bar grooves. The effort control treatments were also applied to the straight section of the stator bar. The effort control treatment is made of paints, paper or ribbon built with epoxy resin, reinforced with carbon or carbon-silicon (SiC) with non-lineal characteristics, wherein the effort control treatment also serves to attach the insulating component to the grounded shielding component. Similarly, there is a power grading treatment for the stator bar, wherein the power grading treatment is made of paints, or ribbons with carbon-silicon immersed in a epoxy matrix, wherein the power grading treatment is used to prevent discharges of the stator bar at the shielding component, thus controlling the dielectric effort during a test.

The power grading treatment is applied to the straight section of the stator bar where there is the shielding component, and longitudinally beyond 25 mm of the shielding component.

During the test of applied electrical tension and inducted temperature with the prototype system, there is, in the stator bar, a direct relation between electric conductance and thermal conductance, and between escalated electric power and thermal power according to the formula:

$$\vec{\nabla}\cdot(\lambda)\vec{\nabla}T=0$$

Wherein

λ=material thermal conductance

T=temperature (escalated thermal power)

An adequate grading power treatment and an adequate grounded shielding component during a test of a stator bar, guarantees an insulation component surface constant conductance of about 0.5 S/m that corresponds to a superficial resistivity of 20,000 ohms$^2$ for a thickness of 0.1 mm for a paint case.

Figure 4:
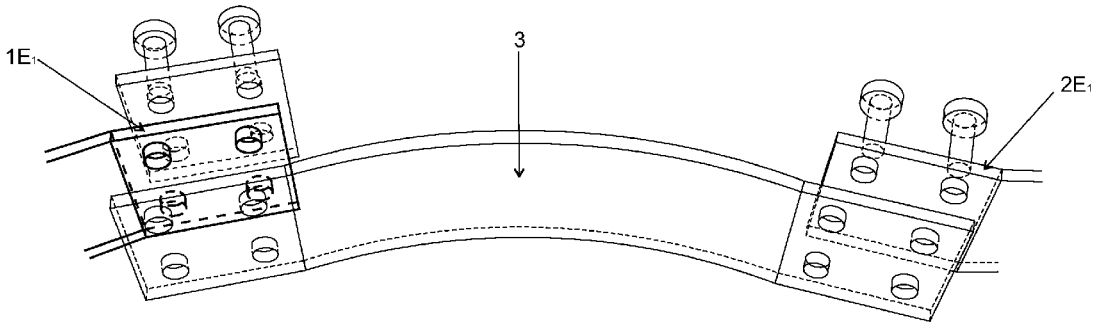
FIG. 4 shows in more detail how the system of the present invention preferred connection attaches an end of electrical winding element to an end of the short circuit conductive element.

The prototype system connections were made with braid copper belts, wherein the braid copper belt ends were electroplated and reinforced with steel in order to obtain high mechanical resistance, to provide thermal homogeneity and to avoid chemical corrosion in environments with high ozone concentrations. The braid copper belts were flexible and had a high range for current conduction (0 to 1500 A). Thus with parallel connections is possible to induct currents of 3000 A. The braid copper belts were attached to the stator bar and to the short circuit conductive element (Copper longitudinal bar) with four screws as it is shown in FIG. 4. The connection choice was made based on the current conductance properties of the braid copper belts, their electric losses, their modes and frequencies (60 Hz) which are similar to the current conductance, electric losses, modes and frequencies of the other elements of the closed short circuit.

The invention claimed is:

1. A system for controlled accelerated thermal aging of electrical windings, wherein the system comprises:

A. An electrical winding element and a short circuit conductive element, wherein the electrical winding element has an inner conductive component and an insulation component; wherein each one of the two elements, the electrical winding element and the short circuit conductive element, have two ends, where the two ends of the electrical winding element are attached to the two ends of the short circuit conductive element by means of two connections, wherein the two attached elements, the electrical winding element and the short circuit conductive element, form a closed short circuit;

B. A step-up transformer, wherein the step-up transformer uses a controlled variable voltage source, wherein the step-up transformer is connected to the closed short circuit, wherein the step-up transformer using a controlled variable voltage source can provide controlled variable charges to the closed short circuit;

C. A reactive power compensation part wrapped around a section of the electrical winding element, wherein the reactive power compensation part has a shielding component and a wrapping component, wherein the shielding component is grounded, wherein the wrapping component is a non-magnetic, non-sparking component;

D. A capacitor device, wherein the capacitor device is connected to the reactive power compensation part; wherein charging of the closed short circuit with a controlled charge by the step-up transformer using a controlled variable voltage source, induces heat in the inner conductive component of the electrical winding element, wherein cycles of controlled charges by the step-up transformer using a controlled variable voltage source, generate cycles of flowing current through the closed short circuit, wherein the cycles of flowing current through the closed short circuit produce cycles of heat by induction in the electrical winding element, wherein said cycles of heat produce thermal aging in the insulating component.

2. The system of claim 1, wherein the electrical winding element is a stator bar.

3. The system of claim 1, wherein the inner conductive component of the electrical winding element is made of copper.

4. The system of claim 1, wherein the short circuit conductive element is made of copper.

5. The system of claim 1, wherein the two connections, that attach into the closed short circuit the electrical winding element and the short circuit conductive element, are made of copper.

6. The system of claim 1, wherein the shielding component of the reactive power compensation part is made of silicon steel iron.

7. The system of claim 1, wherein the wrapping component of the reactive power compensation part is made of aluminum.

* * * * *